US007142086B2

(12) United States Patent
Nguyen et al.

(10) Patent No.: US 7,142,086 B2
(45) Date of Patent: Nov. 28, 2006

(54) ULTRA BROADBAND INDUCTOR ASSEMBLY

(75) Inventors: John A. Nguyen, Hayward, CA (US); Anand Gundavajhala, Cupertino, CA (US)

(73) Assignee: Oplink Communications, Inc., Fremont, CA (US)

( * ) Notice: Subject to any disclaimer, the term of this patent is extended or adjusted under 35 U.S.C. 154(b) by 143 days.

(21) Appl. No.: 10/777,793

(22) Filed: Feb. 11, 2004

(65) Prior Publication Data

US 2004/0227596 A1 Nov. 18, 2004

Related U.S. Application Data

(60) Provisional application No. 60/446,249, filed on Feb. 11, 2003.

(51) Int. Cl.
*H01F 27/28* (2006.01)

(52) U.S. Cl. ..... 336/231; 333/181

(58) Field of Classification Search ..... 336/65, 336/83, 200, 231–232; 333/181
See application file for complete search history.

(56) References Cited

U.S. PATENT DOCUMENTS

| | | | | |
|---|---|---|---|---|
| 1,727,932 | A * | 9/1929 | Medved | 336/129 |
| 2,547,412 | A * | 4/1951 | Salisbury | 455/325 |
| 5,856,767 | A | 1/1999 | D'Oro et al. | |
| 6,509,821 | B1 * | 1/2003 | Oldfield | 336/82 |
| 2002/0057183 | A1 * | 5/2002 | Oldfield | 336/231 |
| 2002/0080002 | A1 * | 6/2002 | Oldfield et al. | 336/231 |

* cited by examiner

*Primary Examiner*—Tuyen T Nguyen
(74) *Attorney, Agent, or Firm*—Fish & Richardson P.C.

(57) ABSTRACT

Systems and apparatuses for providing a broadband inductor assembly. One broadband inductor assembly includes a conical coil inductor having a broad end with radius $r_1$ and a narrow end with radius $r_2$, the conical coil inductor also having a broad end terminal and a narrow end terminal. The broadband inductor assembly includes a base. The broadband inductor assembly includes at least one support, such that the conical coil inductor is supported by the at least one support above the base at a distance greater than or equal to $r_1$ from the base. An ultra broadband bias tee is provided that includes a broadband inductor assembly and a DC block.

11 Claims, 3 Drawing Sheets

ULTRA BROADBAND INDUCTOR ASSEMBLY

CROSS-REFERENCE TO RELATED APPLICATIONS

This application claims the benefit of U.S. Provisional application No. 60/446,249, filed on Feb. 11, 2003, which is incorporated by reference herein.

BACKGROUND

The following specification relates to electronic components. Electrical components operating, for example, at Radio Frequency (RF), microwave and millimeterwave frequencies are typically designed so that the electrical component operates as expected throughout a desired frequency band (or specified operational band). For example, an inductor can be designed to provide inductance throughout a specified operational band. However, there are circumstances in which an inductor in operation will provide capacitance to a circuit instead of inductance. The materials, packaging, and to a large extent the physical structure (i.e., the geometry) of a component contribute intrinsic parasitic resistances, capacitances, and inductances to the make up of the component that can result in a component not operating as desired.

At different frequencies, component parasitics can dominate component performance. Moreover, the parasitics can combine with one another, or other circuit elements, to induce undesired changes—such as glitches, nulls or phase shifts—in signals (narrowband or broadband) traveling through a circuit (or assembly).

Consequently, conventional electrical components are specified and designed to operate over a relatively narrow band, within which the parasitics contributed by the geometry, materials, and packaging of a component can be effectively mitigated. For example, most inductors are designed for operation over a relatively narrow band and may become capacitive past a parasitic resonant frequency due to the above identified intrinsic sources of parasitics.

In developing ultra broadband technologies, for example, back-haul systems provided by the use of OC768 opto-electrical equipment, extremely wide bandwidths are specified and designed for despite the existing narrow band limitation imposed by conventional electrical components included in the equipment design. Ultra broadband networks require undistorted handling of signals through the optical and electrical components. Ultra broadband electrical components must therefore operate well over a continuous band of spectrum.

SUMMARY

The present specification describes systems and apparatuses for providing a broadband inductor.

In general, in one aspect, the specification provides a broadband inductor assembly. The broadband inductor assembly includes a conical coil inductor having a broad end with radius $r_1$ and a narrow end with radius $r_2$, the conical coil inductor also having a broad end terminal and a narrow end terminal. The broadband inductor assembly includes a base. The broadband inductor assembly includes at least one support, such that the conical coil inductor is supported by the at least one support above the base at a distance greater than or equal to $r_1$ from the base.

In general, in another aspect, the specification provides for an ultra broadband bias tee. The ultra broadband bias tee includes a broadband inductor assembly. The broadband inductor assembly includes a conical coil inductor having a broad end with radius $r_1$ and a narrow end with radius $r_2$, the conical coil inductor also having a broad end terminal and a narrow end terminal. The broadband inductor assembly includes a base. The broadband inductor assembly includes at least one support; such that the conical coil inductor is supported above the base at a distance greater than or equal to r from the substantially flat surface of the base. The ultra broadband bias tee includes a DC block assembly coupled to the broadband inductor.

Implementations may include one or more of the following features. The narrow end terminal of the conical coil can be positioned at a minimum height above the substantially flat surface of the base. The narrow end can be operable to provide a high end of an operational band of frequencies for a broadband inductor assembly. The broad end can be operable to provide a low end of an operational band of frequencies for a broadband inductor assembly. The base can include a substantially flat surface. The conical coil inductor can be supported by the at least one support such that such that an imaginary center line through the conical coil is substantially parallel to the base, and also such that the broad end of the conical coil is supported above the base. The at least one support can be composed of a low loss dielectric material. The at least one support can be composed of glass or ceramic. The broadband inductor can further include a cylindrical winding extension coupled to the broad end of the conical coil inductor. The broadband inductor can further include a magnetic core inductor coupled in series to the broad end of the conical coil inductor. The DC block assembly can include an ultra broadband capacitor assembly. The DC block assembly can be integrated into a coplanar waveguide.

The details of the following specification can be implemented to provide one or more of the following advantages. A conical broadband inductor is provided which supports ultra broadband signal transmission from the tens of kilohertz to the tens of gigahertz. By positioning the conical inductor above a circuit surface on both high frequency and low frequency ends, proximity dependant parasitic effects can be reduced or eliminated. The conical inductor can be combined with an ultra broadband capacitor assembly in order to form a ultra broadband bias tee in which the high frequency terminal of the conical broadband inductor can be integrated into the ultra broadband capacitor assembly.

The details of one or more implementations are set forth in the accompanying drawings and the description below.

DESCRIPTION OF DRAWINGS

Like reference symbols in the various drawings indicate like elements.

DETAILED DESCRIPTION

In order to provide an inductor that maintains a desired value of inductance from very low frequencies to at least the tens of gigahertz (GHz), an ultra broadband inductor assembly (UBIA) is provided.

Figure 1:
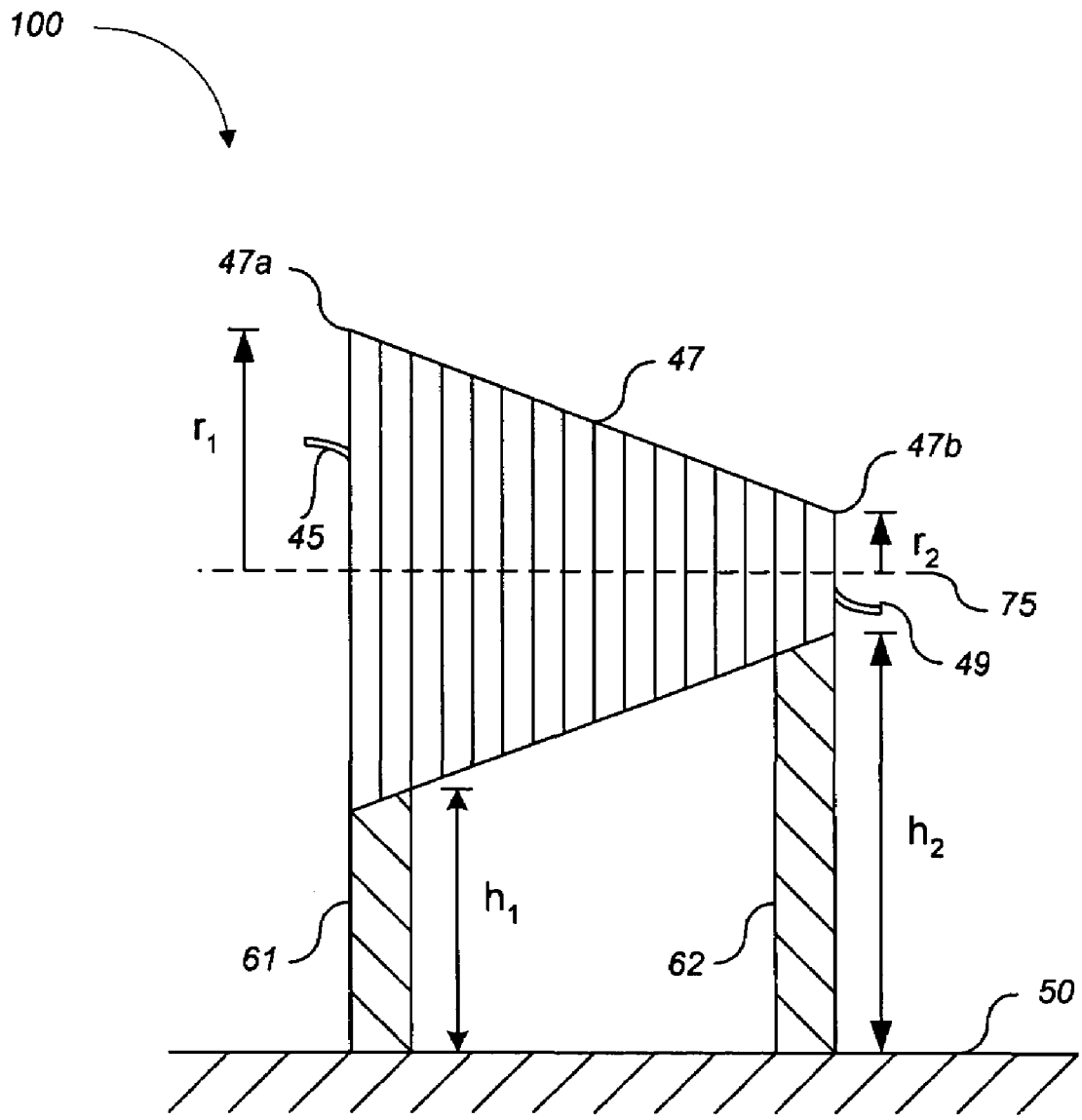
FIG. 1 is a is a side view of an ultra broadband inductor assembly according to one implementation.

Shown in FIG. 1 is a side view of an UBIA 100 according to one implementation. The UBIA 100 includes a conical coil inductor 47 mounted above a package base surface 50 such that an imaginary center line 75 of conical coil inductor 47 is substantially parallel to package base surface 50. In one implementation, the conical coil 47 is supported by one or more supports 61 and 62 each having a respective height $h_1$ and $h_2$.

In alternative implementations, the one or more supports 61 and 62 can be rods. In another implementation, conical coil inductor 47 can be supported by a dielectric material. For example, glass rods can be used to replace supports 61 and 62. Additionally, supports 61 and 62 can be replaced with a single low loss duroid support or ceramic form that supports conical coil 47 above package base surface 50. In other implementations, package base surface 50 can be a surface or plate that is used within a larger circuit assembly.

Conical coil 47 has a broad end 47*a* and a narrow end 47*b* with respective radius $r_1$ and $r_2$. Conical coil 47 also has a broad end terminal 45 and a narrow end terminal 49 to which other components can be coupled. In one implementation, conical coil 47 can be mounted so that narrow end terminal 49 is positioned close to a top of support 62. In one implementation, narrow end terminal 49 is positioned to directly contact a component positioned at a same height as $h_2$. Alternatively, contact can be made with a component through a lead line to a component at a different height as compared to $h_2$ (e.g., lower). In some implementations, the lead line is designed to be short in order to minimize interference or other detrimental effects. Similarly, the lead line connecting the broad end terminal 45 with another component or transmission medium can also be designed with a length that minimizes detrimental circuit effects.

In one implementation, the height $h_1$ of support 61 is set to be at least equal to and just slightly longer than the value of $r_1$. By raising conical coil 47 off package base surface 50 on both the broad and narrow ends, 47*a* and 47*b*, the parasitic coupling paths between conical coil 47 and package base surface 50 can be minimized. Raising the conical conductor by at least $r_1$ equal to or greater than $r_1$ reduces or eliminates parasitic effects.

In operation, narrow end 47*b* of conical coil 47 has the greatest impact on the high frequency signal components traveling through conical coil 47. Similarly, broad end 47*a* of conical coil 47 impacts, in part, the low frequency signal components traveling through conical coil 47. The two radii $r_1$ and $r_2$ are respectively scaled to set, in part, the low and high ends of the operational frequency bandwidth of UBIA 100. The lowest frequency and the highest frequency thereby defining the continuous frequency band over which the UBIA 100 operates at a desired value of inductance.

UBIA 100 can be integrated into a hybrid microwave integrated circuit environment. In one implementation, UBIA is integrated into a hybrid microwave integrated circuit including a coplanar waveguide in combination with UBIA 100 instead of a microstrip line as the transmission medium near UBIA 100. In another implementation, the coplanar waveguide is a suspended and truncated coplanar waveguide (STCPW). Examples of coplanar waveguides are described in a U.S. patent application filed Feb. 11, 2004 by the same inventors and assigned to Oplink Communications, Inc. entitled "Suspended and Truncated Coplanar Waveguide." In a STCPW the electromagnetic field of the fundamental mode supported by the STCPW is tightly bound to the slots between the signal and coplanar ground conductors of the STCPW. The fringing fields that will interact with other nearby components such as the UBIA 100 causing deterioration in the broadband performance of conical coil 47 are thereby reduced. In implementations incorporating microstrip transmission lines, the fringing fields around microstrip transmission lines are far less tightly bound to the proximity of the microstrip transmission line as compared to the fringing fields of the STCPW line.

Figure 2:
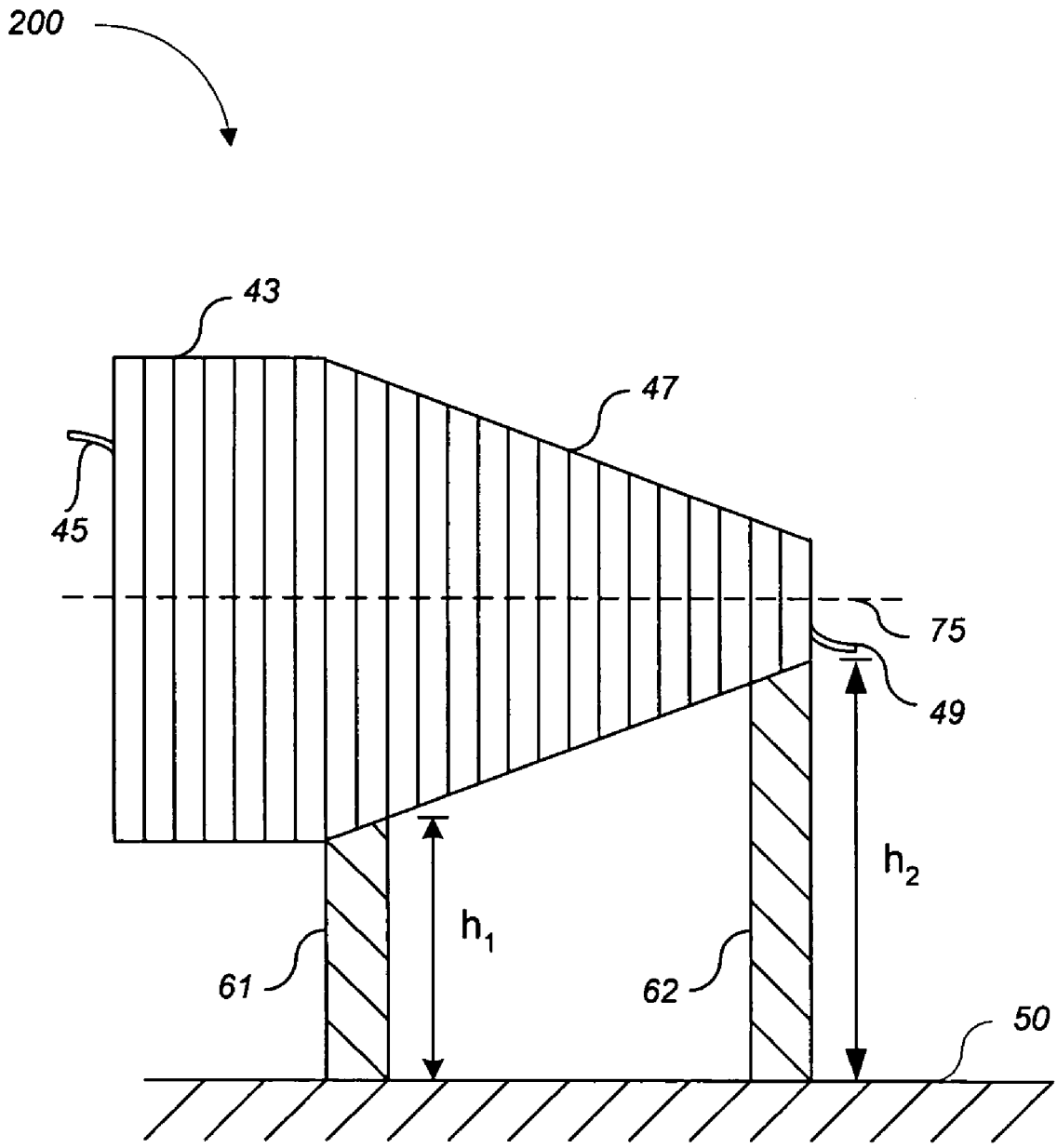
FIG. 2 is a side view of an ultra broadband inductor assembly according to one implementation.

In another implementation shown in FIG. 2, the low end of the operational bandwidth of an UBIA 200 can be extended by introducing a cylindrical winding extension 43 that, in one implementation, is smaller than half the length of conical coil 47. In one implementation, the windings of cylindrical winding extension 43 are layered N-deep. In one implementation, N is an odd number. In other implementations of UBIA 100, the low end of the operational bandwidth may be extended even further by placing a separate magnetic core inductor (not shown)—that is physically positioned away from conical coil 47—in series with conical coil 47. A resistor (not shown) can be positioned in parallel with the magnetic core inductor in order to suppress the self-resonance of the magnetic core inductor.

Figure 3:
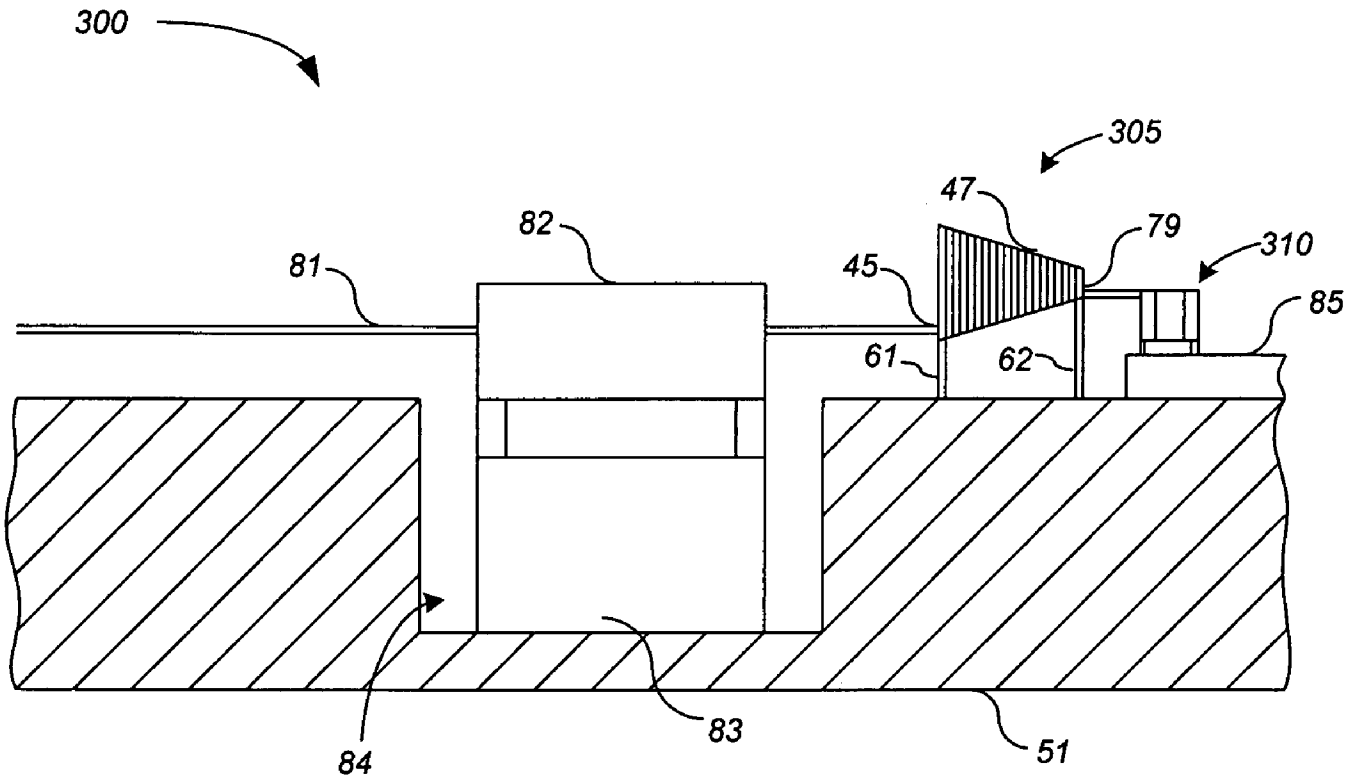
FIG. 3 is a side view of an ultra broadband bias tee including an ultra broadband inductor assembly.

Additionally, an UBIA can be used to implement practical circuits such as an ultra broadband bias tee (UBBT). FIG. 3 illustrates one implementation of an UBBT 300. UBBT 300 includes a DC block assembly 310. The DC block assembly can include an ultra broadband capacitor assembly (UBCA), one example of which is described in a U.S. patent application filed Feb. 11, 2004, by the same inventors and assigned to Oplink Communications, Inc. entitled "Ultra Broadband Capacitor Assembly." UBBT 300 includes a DC feed-thru pin 81 providing input into UBBT 300. DC feed-thru pin 81 is coupled in parallel to a resistor 82 and a magnetic core inductor 83. As described above, magnetic core inductor 83 can be used to extend the low frequency range of an UBIA such as UBIA 305.

UBIA 305 includes conical coil inductor 47, broad end terminal 45 and narrow end terminal 79, and supports 61 and 62. Magnetic core inductor 83 is positioned within a recess 84 in support base 51 away from the UBIA 305 conical coil inductor 47 and other active circuit elements. A wire jump 80 couples the resistor 82 and magnetic core inductor 83 to the broad end terminal 45 of conical coil inductor 47. Narrow end terminal 49 of UBIA 305 is coupled to UBCA 310, which is integrated into a STCPW 85.

A number of implementations have been described. Nevertheless, it will be understood that various modifications may be made without departing from the spirit and scope of the present specification. Accordingly, other embodiments are within the scope of the following claims.

What is claimed is:

1. A broadband inductor assembly comprising:

a conical coil inductor having a broad end with radius $r_1$ and a narrow end with radius $r_2$, the conical coil inductor also having a broad end terminal and a narrow end terminal;

a base; and at least one support, such that the conical coil inductor is supported by the at least one support above the base at a predetermined distance greater than or equal to $r_1$ from the base where the predetermined distance between the base and the conical coil inductor is selected such that parasitic coupling paths between the conical coil inductor and the base are substantially minimized over a frequency broadband spectrum.

2. The broadband inductor assembly of claim 1, wherein the narrow end terminal of the conical coil is positioned at a minimum height above a substantially flat surface of the base.

3. The broadband inductor assembly of claim 1, wherein the narrow end is operable to provide a high end of an operational band of frequencies for a broadband inductor assembly.

4. The broadband inductor assembly of claim 1, wherein the broad end is operable to provide a low end of an operational band of frequencies for a broadband inductor assembly.

5. The broadband inductor assembly of claim 1, wherein the base includes a substantially flat surface.

6. The broadband inductor assembly of claim 1, wherein the conical coil inductor is supported by the at least one support such that such that an imaginary center line through the conical coil is substantially parallel to the base, and also such that the broad end of the conical coil is supported above the base.

7. The broadband inductor assembly of claim 1, wherein the at least one support is composed of a low loss dielectric material.

8. The broadband inductor assembly of claim 7, wherein the at least one support is composed of glass.

9. The broadband inductor assembly of claim 7, wherein the at least one support is composed of ceramic.

10. The broadband inductor assembly of claim 1, further comprising:

a cylindrical winding extension coupled to the broad end of the conical coil inductor.

11. The broadband inductor assembly of claim 1, further comprising:

a magnetic core inductor coupled in series to the broad end of the conical coil inductor.

* * * * *